US007053849B1

(12) United States Patent
Pike et al.

(10) Patent No.: US 7,053,849 B1
(45) Date of Patent: May 30, 2006

(54) SWITCHABLE POLARIZER

(75) Inventors: Mathew Pike, Plymouth (GB); Raymond Watson, Newton Abbot (GB); Paul Tresise, Kinstaington (GB)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/904,762

(22) Filed: Nov. 26, 2004

(51) Int. Cl.
*H01Q 13/00* (2006.01)

(52) U.S. Cl. ..... 343/786; 343/756; 333/21

(58) Field of Classification Search ..... 343/756, 343/786, 771; 333/21, 161
See application file for complete search history.

(56) References Cited

U.S. PATENT DOCUMENTS

| | | | | |
|---|---|---|---|---|
| 2,438,119 | A | 3/1948 | Fox | |
| 3,259,015 | A * | 7/1966 | Marcatili | 359/247 |
| 3,484,784 | A * | 12/1969 | McLeod, Jr. | 342/157 |
| 3,715,688 | A * | 2/1973 | Woodward | 333/1 |
| 3,939,445 | A | 2/1976 | Liguori | 333/98 |
| 4,030,048 | A * | 6/1977 | Foldes | 333/135 |
| 4,353,041 | A | 10/1982 | Bryans et al. | 333/21 A |
| 4,613,836 | A | 9/1986 | Evans | 333/159 |
| 4,875,027 | A | 10/1989 | Spinner | 333/254 |
| 5,162,808 | A | 11/1992 | Kim | 343/786 |
| 5,364,136 | A | 11/1994 | Forti et al. | 285/176 |
| 5,517,203 | A * | 5/1996 | Fiedziuszko | 343/756 |
| 6,005,528 | A | 12/1999 | Preiss et al. | 343/786 |
| 6,130,649 | A | 10/2000 | Wojtkowiak et al. | 343/786 |
| 6,166,610 | A | 12/2000 | Ramanujam et al. | 333/21 A |
| 6,404,298 | B1 | 6/2002 | Rohr et al. | 333/21 A |
| 6,720,840 | B1 | 4/2004 | Bohnet | 333/21 A |

* cited by examiner

*Primary Examiner*—Tan Ho
(74) *Attorney, Agent, or Firm*—Babcock IP, LLC

(57) ABSTRACT

A switchable polarizer assembly, having a coupler, a polarizer module with a plurality of apertures, each aperture adapted for a desired transition, an antenna adapter and a central waveguide with a center longitudinal axis passing through the coupler and the antenna adapter. Positioned inline with the central waveguide, between the coupler and the antenna adapter, the polarizer module is offset relative to the center longitudinal axis, rotatable to alternatively align each of the plurality of apertures with the central waveguide. A coupling means may be present to couple rotation of the polarizer module to rotation of the antenna adapter. The apertures may be, for example, zero or ninety degree angular transitions and or circular to rectangular waveguide cross sectional area transitions.

19 Claims, 5 Drawing Sheets

SWITCHABLE POLARIZER

BACKGROUND

1. Field of the Invention

This invention relates to equipment useful in high frequency radio communications systems. More particularly, the invention is concerned with a switchable polarizer for changing the polarization of signals passing through a waveguide.

2. Description of Related Art

Rotator elements placed in-line with a waveguide are useful for changing the polarization of a signal prior to further processing. For example, waveguides associated with antennas often incorporate switchable polarizer functionality to allow conversion of the antenna between horizontal and vertical polarization.

The geometries of standard in-line polarizer transition elements are well known in the art. Prior switchable polarizer solutions have typically incorporated one of three general approaches. First, the polarizer element may be removable. A user alternatively installs one or another dedicated component by fully disassembling the waveguide and inserting a separate transition element designated for each desired polarization. Where no transition is required, the polarizer element is typically a straight pass through waveguide section to minimize electrical losses. This approach requires the inventory and storage, perhaps for years, of redundant transition components until they are needed, if ever.

Second, the transition components may be formed as a plurality of plates that bolt together in alternative configurations for each desired polarization. Further developments of this approach have used pins and slots to allow rotation of the various plates between polarization configurations without requiring complete removal and restacking of the plurality of plates. However, each of the transitions between the separate plates inhibits electrical signal flow, creating an electrical loss and contributing to an overall tolerance error that increases with the number of separate components. High manufacturing tolerances required to minimize these effects significantly contributes to the cost of this solution. Further, the plurality of plates increases the length of the resulting assembly, increasing overall structural requirements. When no polarization change is required, the plates are adaptable into a stacked straight pass through waveguide section configuration.

A third solution is to form a single transition component having transition cavities and faces formed complementary to dual orthogonal polarizations depending upon the connection orientation of the associated waveguides. This solution reduces the number of overall components required and thereby the associated transition errors and or tolerance losses related to the prior multiple separate components. However, where no signal change is desired, rather than allowing the signal to pass through without transition, this solution performs a signal translation having a net effect of zero degrees. Therefore, this solution forces a compromise wherein a significant electrical loss is incorporated by the transition element whether or not a polarization change is desired. Further, the orientation of associated transmitter or receiver equipment may be fixed, for example for environmental sealing and or cooling purposes, preventing their rotation with respect to a waveguide mounting point.

Depending upon the specific equipment combination used, a waveguide cross-section transition between, for example, a circular to rectangular waveguide may also be required as a further additional component located for example, between an antenna and a transmitter or receiver.

Competition within the waveguide and RF equipment industries has focused attention upon improving electrical performance, reduction of the number of overall unique components, as well as reductions of manufacturing, installation and or configuration costs.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serves to explain the principles of the invention.

DETAILED DESCRIPTION

Figure 1:
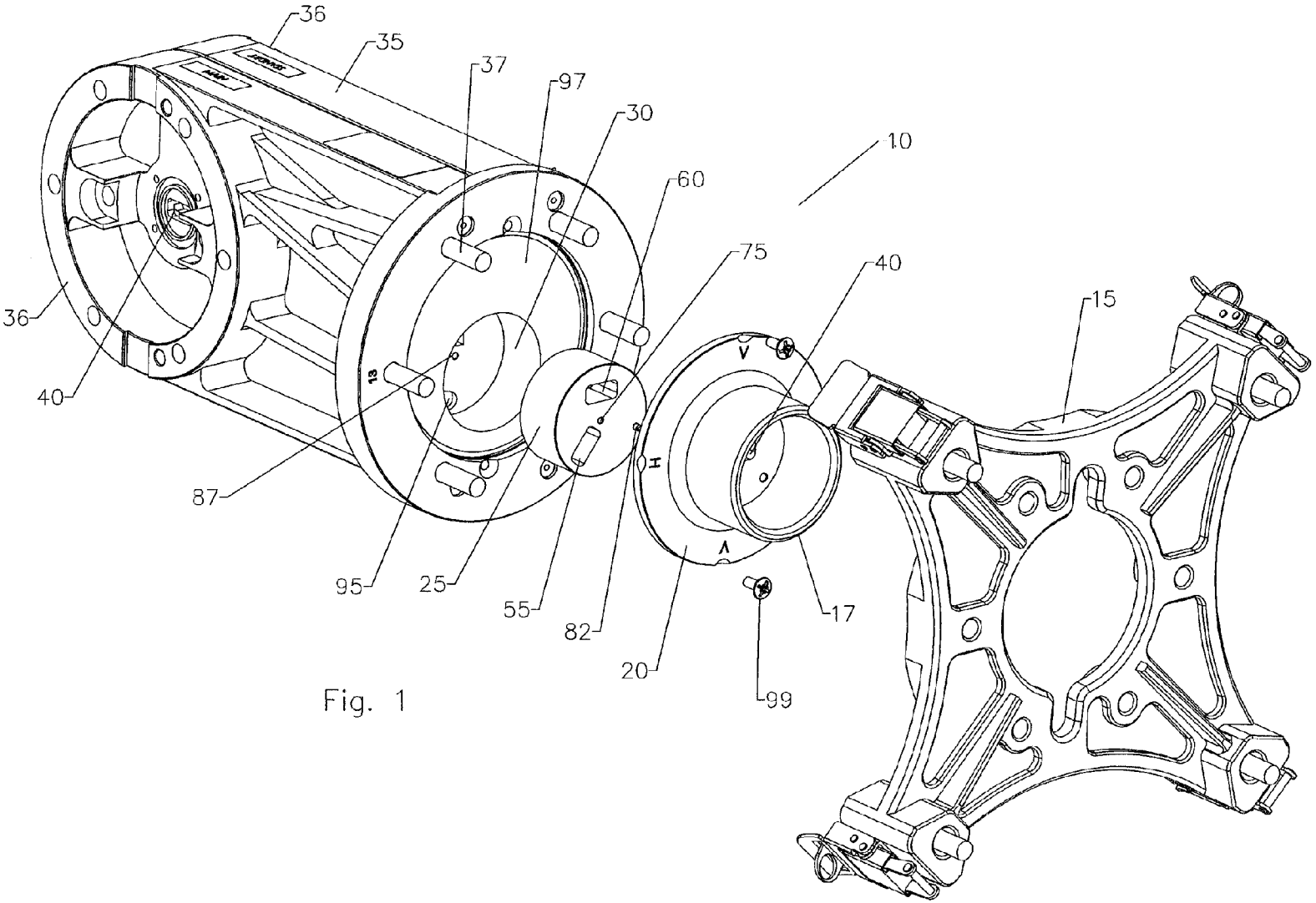
FIG. 1 is a schematic exploded isometric view of a switchable polarizer assembly according to the invention, adapted for use with a reflector antenna.
Figure 2:
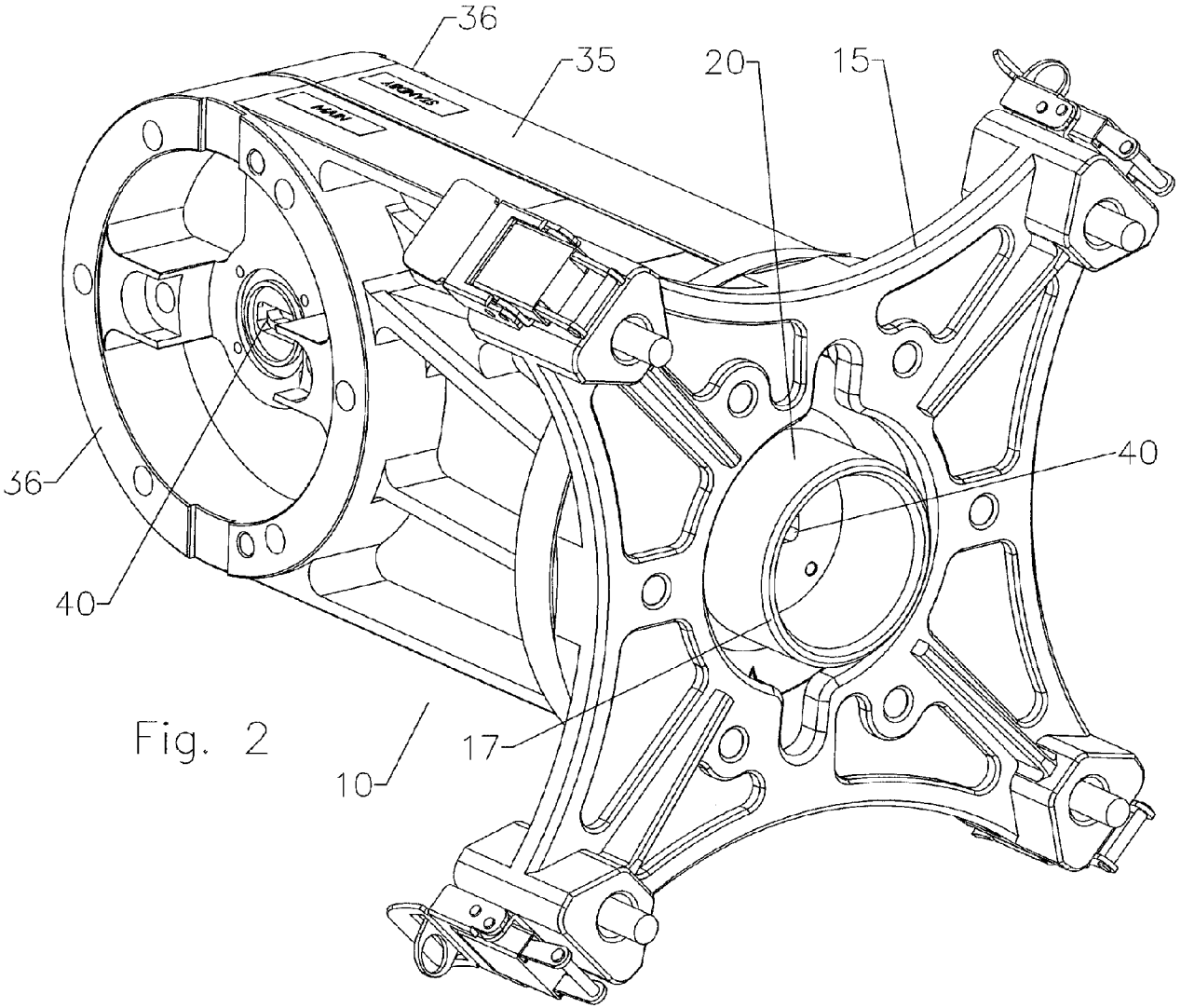
FIG. 2 is a schematic isometric view of FIG. 1, assembled.

An exemplary embodiment of the invention is shown in FIGS. 1–8. In this embodiment, a switchable polarizer function according to the invention is incorporated into the coupling assembly 10 of a reflector antenna. The reflector antenna reflector dish, not shown, is connectable to a mounting bracket 15. A feed assembly, not shown, of the reflector antenna is adapted to mate with the alignment collar 17 of an antenna adapter 20 rotationally coupled to a polarizer module 25 located in the polarizer recess 30 of a coupler 35. The coupler 35 is shown is a "hot standby coupler" which further divides a signal path between two transmitters and or receivers, not shown, mountable to connection point(s) 36 at either side of the back end of the coupler 35. Alternatively, the coupler 35 may be any form of adaptation assembly for a desired component or further waveguide sections. The mounting bracket 15 is adapted to be retained upon the coupler 35, without interfering with rotation of the antenna adapter 20, by a plurality of mounting screws 37 or the like.

A central waveguide 40 extends from the antenna feed assembly to the transmitter(s) and or receiver(s) coupled to the coupler 35. By rotating the polarizer module 25, within the polarizer recess 30, about a rotational axis offset from a center longitudinal axis of the central waveguide 40, alternative transition apertures formed in the polarizer module 25 may be positioned in-line with the central waveguide 40 to adjust a signal polarization and or adapt the waveguide cross section configuration.

Figure 3:
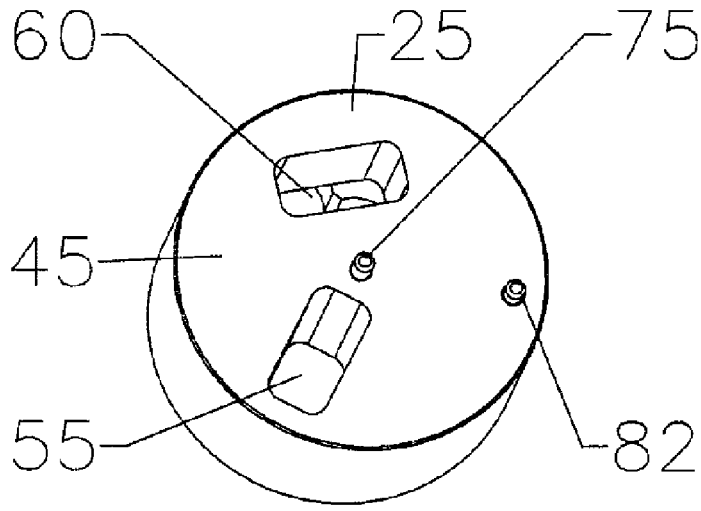
FIG. 3 is a schematic isometric view of a front side of a dual port polarizer module.
Figure 4:
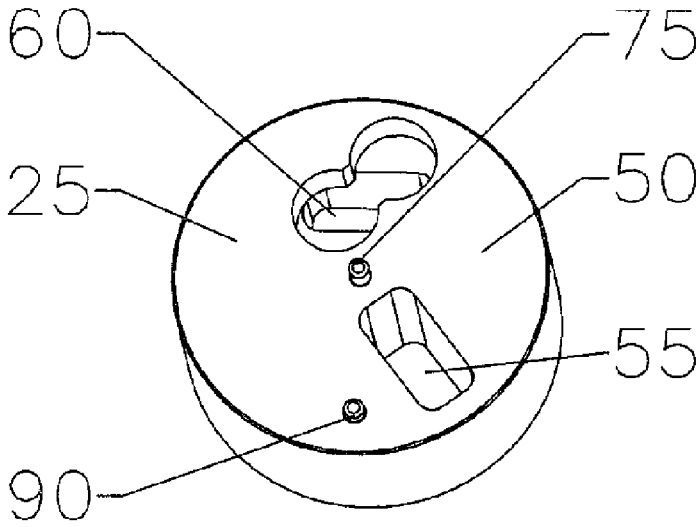
FIG. 4 is a schematic isometric view of a back side of the dual port polarizer module of FIG. 3.
Figure 5:
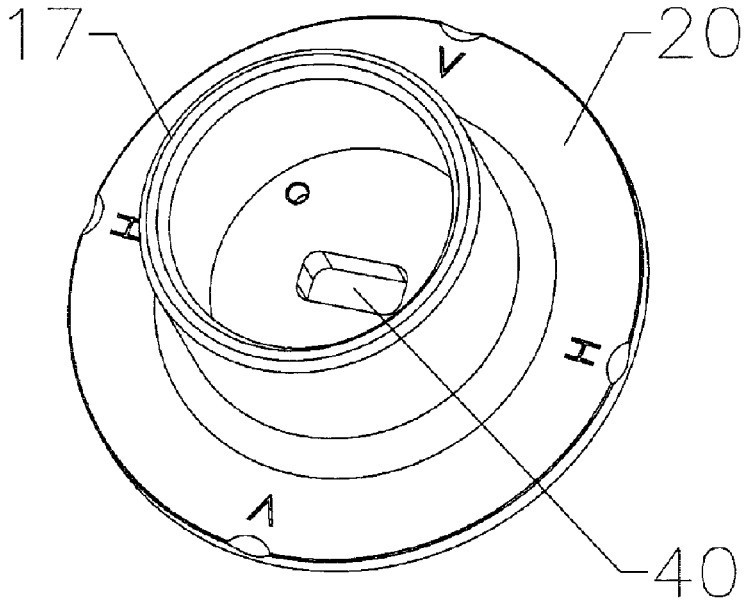
FIG. 5 is a schematic isometric view of a front side of an antenna adapter.
Figure 6:
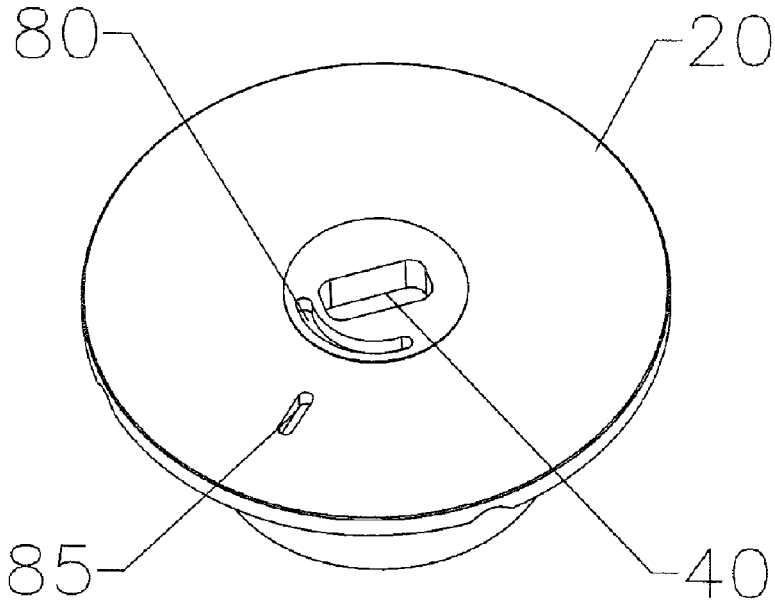
FIG. 6 is a schematic isometric view of a back side of the antenna adapter of FIG. 5.

As shown in FIGS. 3 and 4, the polarizer module 25 is preferably cylindrical with a flat front face 45 and a flat back face 50. Each of the apertures may be adapted for a different signal rotation angle and or waveguide configuration adaptation. For example, a pass-through horizontal aperture 55 has a zero degree rotation angle while a vertical aperture 60 has a ninety degree rotation angle. Similarly, the apertures may be formed as, for example, conversions between rectangular and circular waveguides with or without signal rotation. The geometric configuration(s) of a waveguide angular and or cross sectional transition are well known in the art and therefore further details thereof are unnecessary.

Pins projecting from the front face 45 and back face 50 of the polarizer module 25 may be used to key the polarizer module 25 to a front mating surface 65 of the coupler 35 and a back mating surface 70 of the antenna adapter 20. The polarizer module 25 is rotatable about a center pin 75 that engages a central pin hole 87 within the polarizer recess 30 of the coupler 35. At the front face 45, the central pin 75 of the polarizer module 25 engages a curved adapter slot 80 formed in the back mating surface of the antenna adapter 20. Also, an offset front pin 82 of the polarizer module 25 engages a tangential slot 85 on the antenna adapter 20 back mating surface 70. Similarly, at the back face 50 an offset back pin 90 of the polarizer module 25 engages a curved coupler slot 95 of the coupler 35.

The several pins and their associated mating hole and or slots operate as a means for coupling to transfer rotation of the antenna adapter 20 centered upon a center longitudinal axis of the central waveguide 40 to offset rotation of the polarizer module 25. Thereby, rotation of the antenna adapter 20 within an antenna adapter recess 97 of the coupler 35 drives rotation of the polarizer module 25 within the polarizer recess 30 such that when the antenna adapter 20 is rotated, the polarizer horizontal and vertical aperture(s) 55,60 are exchanged. The extents of each of the curved adapter and coupler slot(s) 80,95 may be adapted to operate as stops for their respective pins to prevent rotation of the polarizer module 25 beyond the end of range positions that alternatively align each polarizer module 25 aperture with the central waveguide 40. Alternative means for coupling may include, for example, gearing, cams and mechanical linkages or the like.

Figure 7:
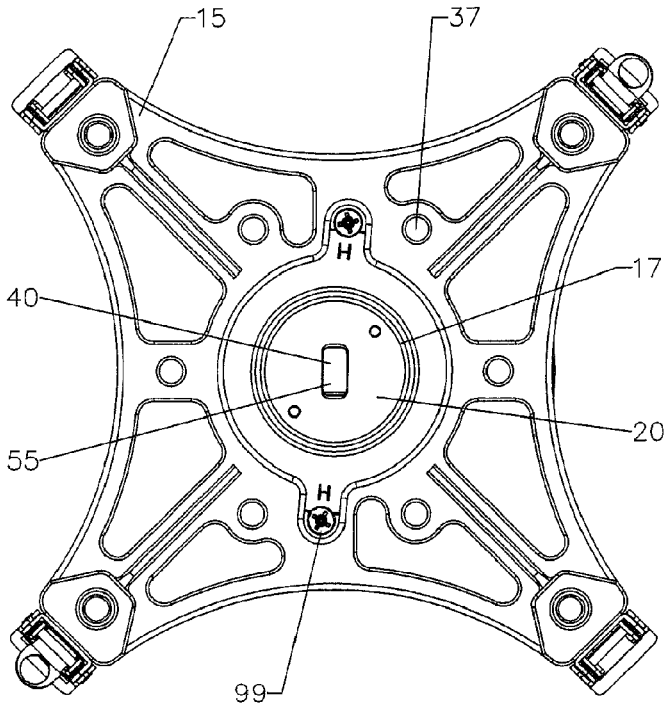
FIG. 7 is a schematic front view of FIG. 2, with the polarizer module in the zero degree, horizontal, position.
Figure 8:
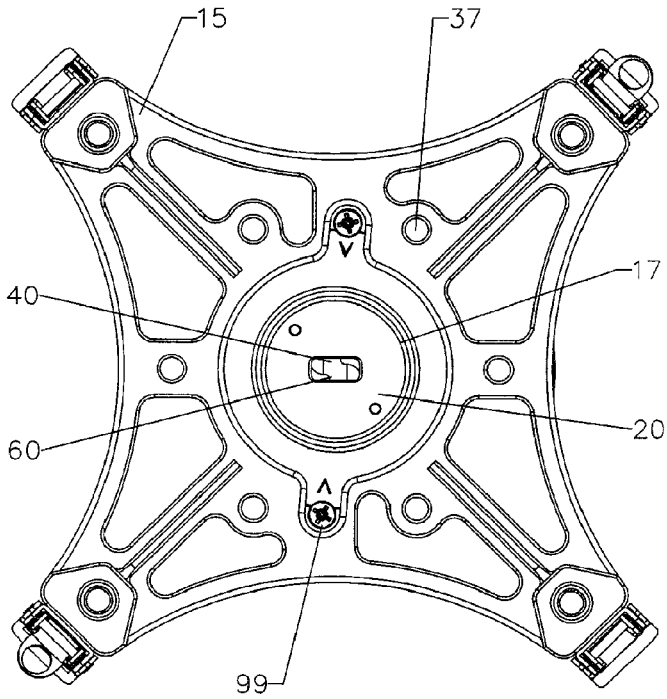
FIG. 8 is a schematic front view of FIG. 2, with the polarizer module in the ninety degree, vertical, position.

In use, the polarization of a reflector antenna configured according to the exemplary embodiment may be adapted between vertical and horizontal polarization by uncoupling the reflector dish, loosening a retaining means such as one or more retaining screw(s) 99 or the like and rotating the antenna adapter 20 between the desired horizontal and vertical positions, as shown in FIGS. 7 and 8, respectively. Because the antenna adapter 20 is rotatable within the antenna adapter recess 97 and thereby the polarizer module 25 within the polarizer recess 30 without requiring removal of the mounting bracket 15, further disassembly of the coupling assembly 10 is unnecessary.

In other embodiments the invention may, for example, be applied to antennas with a circular cross section waveguide feed assembly by forming the antenna adapter 20 with a circular aperture and incorporating a circular to rectangular transition into each of the polarizer module 25 apertures.

One skilled in the art will appreciate that the present invention is not limited to use with antennas but may be incorporated into any waveguide application where alternate transitions are desired. Also, while a dual transition embodiment has been described in detail, the number of transitions is limited only by the selected diameter of the polarizer module 25. Rather than a means for coupling to a dedicated antenna adapter 20, the polarizer module 25 may be driven independently by alternate rotation means, such as any form of linkage, gearing, manual or lever action.

The limited number of required discrete components within the waveguide path improves both electrical performance and manufacturing efficiencies. Also, the ease of exchange between the available apertures reduces the opportunity for assembly errors and lowers maintenance costs, overall.

Table of Parts

| | |
|---|---|
| 10 | coupling assembly |
| 15 | mounting bracket |
| 17 | alignment collar |
| 20 | antenna adapter |
| 25 | polarizer module |
| 30 | polarizer recess |
| 35 | coupler |
| 36 | connection point |
| 37 | mounting screw |
| 40 | central waveguide |
| 45 | front face |
| 50 | back face |
| 55 | horizontal aperture |
| 60 | vertical aperture |
| 65 | front mating surface |
| 70 | back mating surface |
| 80 | curved adapter slot |
| 82 | front pin |
| 85 | tangential slot |
| 87 | central pin hole |
| 90 | back pin |
| 95 | coupler slot |
| 97 | antenna adapter recess |
| 99 | retaining screw |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A switchable polarizer assembly, comprising:

a polarizer module having a plurality of apertures, each aperture adapted for a desired transition; and a central waveguide having a center longitudinal axis;

the polarizer module positioned inline with the central waveguide;

the polarizer module offset relative to the center longitudinal axis, rotatable to alternatively align each of the plurality of apertures with the central waveguide.

2. The assembly of claim 1, wherein the plurality of apertures is a horizontal aperture and a vertical aperture;

the horizontal aperture formed as a pass through transition;

the vertical aperture formed as a ninety degree transition.

3. The assembly of claim 1, wherein at least one of the transitions is between a circular and a rectangular waveguide cross section.

4. The assembly of claim 1, further including an antenna adapter adjacent a front side of the polarizer module.

5. The assembly of claim 4, wherein the antenna adapter is rotatable about the center longitudinal axis of the waveguide.

6. The assembly of claim 5, wherein the antenna adapter is coupled to the polarizer module whereby rotation of the antenna adapter produces an offset rotation of the polarizer module.

7. The assembly of claim 6, wherein the coupling between the antenna adapter and the polarizer module is a plurality of pins projecting from a front face of the polarizer module that engage a plurality of grooves formed in a back mating surface of the antenna adapter.

8. A switchable polarizer assembly, comprising;

a coupler having a polarizer recess and an antenna adapter recess;

a polarizer module having a plurality of apertures transitions, each aperture adapted for a desired transition;

an antenna adapter; and a central waveguide, having a center longitudinal axis, extending through the coupler and the antenna adapter;

the antenna adapter recess centered upon the center longitudinal axis and the polarizer recess offset from the center longitudinal axis;

the polarizer module positioned in the polarizer recess, whereby rotation of the polarizer module alternatively aligns each of the plurality of aperture transitions with the central waveguide;

the antenna adapter positioned in the antenna adapter recess, retaining the polarizer module within the polarizer recess.

9. The assembly of claim 8, further including a plurality of pins projecting from a front face of the polarizer module that engage a plurality of grooves formed in a back mating surface of the antenna adapter;

the plurality of pins and the plurality of grooves operating to transfer rotation of the antenna adapter about the center longitudinal axis to an offset rotation of the polarizer module.

10. The assembly of claim 8, further including a coupling means between the polarizer module and the antenna adapter; the coupling means operating to transfer rotation of the antenna adapter about the center longitudinal axis to an offset rotation of the polarizer module.

11. The assembly of claim 8, further including a mounting bracket coupled to the coupler;

the mounting bracket retaining the antenna adapter, rotatable, in the antenna adapter recess.

12. The assembly of claim 11, wherein the mounting bracket is adapted to mate with a reflector dish.

13. The assembly of claim 8, wherein the plurality of apertures is a horizontal aperture and a vertical aperture;

the horizontal aperture formed as a pass through transition;

the vertical aperture formed as a ninety degree transition.

14. The assembly of claim 8, wherein at least one of the apertures is a transition between a circular and a rectangular waveguide cross section.

15. The assembly of claim 8, wherein the central waveguide extends to two equipment connection points on the coupler.

16. The assembly of claim 8, further including retaining means for keying the antenna adaptor into a desired orientation with respect to the coupler.

17. A switchable polarizer assembly, comprising:

a coupler;

a polarizer module having a plurality of apertures, each aperture adapted for a desired transition;

an antenna adapter; and a central waveguide with a center longitudinal axis passing through the coupler and the antenna adapter;

positioned inline with the central waveguide, between the coupler and the antenna adapter, the polarizer module offset relative to the center longitudinal axis, rotatable to alternatively align each of the plurality of apertures with the central waveguide.

18. The assembly of claim 17, further including a means for coupling between the antenna adapter and the polarizer module whereby rotation of the antenna adapter drives rotation of the polarizer module.

19. The assembly of claim 18, wherein the means for coupling is a plurality of pins on the polarizer module that engage a plurality of slots on the antenna adapter.

* * * * *